US009770619B1

(12) United States Patent
Bullock

(10) Patent No.: US 9,770,619 B1
(45) Date of Patent: Sep. 26, 2017

(54) MULTIPLE EXERCISE MEDICINE BALL

(71) Applicant: Mark Bullock, Linden, NJ (US)

(72) Inventor: Mark Bullock, Linden, NJ (US)

( * ) Notice: Subject to any disclaimer, the term of this patent is extended or adjusted under 35 U.S.C. 154(b) by 0 days.

(21) Appl. No.: 15/178,934

(22) Filed: Jun. 10, 2016

(51) Int. Cl.

| | |
|---|---|
| ***A63B 21/06*** | (2006.01) |
| ***A63B 21/22*** | (2006.01) |
| ***A63B 21/072*** | (2006.01) |
| ***A63B 21/00*** | (2006.01) |

(52) U.S. Cl.
CPC ..... *A63B 21/0603* (2013.01); *A63B 21/072* (2013.01); *A63B 21/22* (2013.01); *A63B 21/4035* (2015.10)

(58) Field of Classification Search
USPC ..... 482/1–148
See application file for complete search history.

(56) References Cited

U.S. PATENT DOCUMENTS

| | | | | |
|---|---|---|---|---|
| 5,713,823 | A * | 2/1998 | Walendzak | A63B 22/18 482/139 |
| 6,190,292 | B1 | 2/2001 | Panes | |
| 7,175,573 | B1 | 2/2007 | Huang | |
| D552,696 | S | 10/2007 | Hallar | |
| 7,883,452 | B1 * | 2/2011 | Chen | A63B 21/072 482/108 |
| 7,993,250 | B2 | 8/2011 | Abbott | |
| 8,454,483 | B1 | 6/2013 | Bradley et al. | |
| 8,870,719 | B2 | 10/2014 | Johnson et al. | |
| 8,944,971 | B2 * | 2/2015 | Shorter | A63B 21/072 482/107 |
| 9,011,303 | B2 | 4/2015 | MacColl et al. | |
| 9,327,155 | B2 * | 5/2016 | Doyle | A63B 21/00 |
| 2015/0190672 | A1 * | 7/2015 | Rost | A63B 23/0355 482/93 |
| 2017/0021218 | A1 * | 1/2017 | Peritz | A63B 21/4035 |

* cited by examiner

*Primary Examiner* — Stephen R Crow
(74) *Attorney, Agent, or Firm* — Stevenson IP, LLC

(57) ABSTRACT

A multiple exercise medicine ball including a medicine ball body having core, a pair of diametrically opposed indents in an outer wall thereof, and a pair of u-shaped handles which extend from the indents and can be raised for use as a dumbbell, a barbell and a curl bar. A pair of cylindrical bars, rotatably disposed in a pair of channels in the core and extending outwardly through a center of the indents, can be gripped while the user in a pushup exercise position to perform an abdominal wheel exercise. An inverted substantially u-shaped grip member, which extends from atop the medicine ball, is used for kettlebell fitness training. A 360 degree rotatable motion ball protrudes from a bottom side of the medicine ball body.

2 Claims, 6 Drawing Sheets

MULTIPLE EXERCISE MEDICINE BALL

BACKGROUND OF THE INVENTION

Various types of exercise balls are known in the prior art. However, what is needed, and what the present device provides, is a multiple exercise medicine ball having a pair of u-shaped handles which extend from a pair of indents in an outer wall thereof, a pair of bars which extend outwardly from a center of the indents, a grip member which extends from atop the medicine ball to accommodate the performance of a wide range of exercises, and a 360 degree motion ball which protrudes outwardly from a bottom side of the medicine ball.

FIELD OF THE INVENTION

The present invention relates to exercise balls, and more particularly, to a multiple exercise medicine ball.

SUMMARY OF THE INVENTION

The general purpose of the present multiple exercise medicine ball, described subsequently in greater detail, is to provide a multiple exercise medicine ball which has many novel features that result in a multiple exercise medicine ball which is not anticipated, rendered obvious, suggested, or even implied by prior art, either alone or in combination thereof. To accomplish this, the present multiple exercise medicine ball includes a medicine ball body having an outer wall and a weighted core. A pair of hemispherical indents is disposed in the outer wall in a position diametrically opposed to each other. A u-shaped handle is pivotably disposed in each indent. When a single one of or both of the pair of handles is in the raised condition, the medicine ball body can be lifted and lowered for use as a dumbbell or as a barbell or a curl bar, respectively. An annular support member is centrally disposed within each of the indents in a position within a gap of the respective handle. A pair of channels is disposed in the medicine ball body core with each channel having a central opening and a terminal end disposed between the apex of the respective indent and the longitudinal midline axis of the medicine ball body. A cylindrical bar is rotatably disposed within each of the channels and extendible from the respective one of the channels. When the cylindrical bars are extended from the channels, the medicine ball body is rotatable relative the bars to roll back and forth across an exercise surface for use as an abdominal wheel exerciser.

An inverted substantially u-shaped conduit is disposed within the medicine ball body and has an obround opening atop the outer wall. A convex grip member is slidingly disposed within the conduit when the grip member is in a retracted condition and is extended outside the outer wall beyond the top side of the medicine ball body in an alternate extended condition. The grip member is provided to allow the medicine ball body to be held, lifted, and lowered for kettlebell fitness training. A 360 degree rotatable motion ball is disposed within a bottom side of the medicine ball body. A portion of the motion ball protrudes beyond the outer wall. In addition, to the exercises described hereinabove, the user can also use the present device to engage in a wide range of strength-training exercises to add resistance to movements during various exercises such as sit-ups, crunches, cardio exercises, and jumps.

Thus has been broadly outlined the more important features of the present multiple exercise medicine ball so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
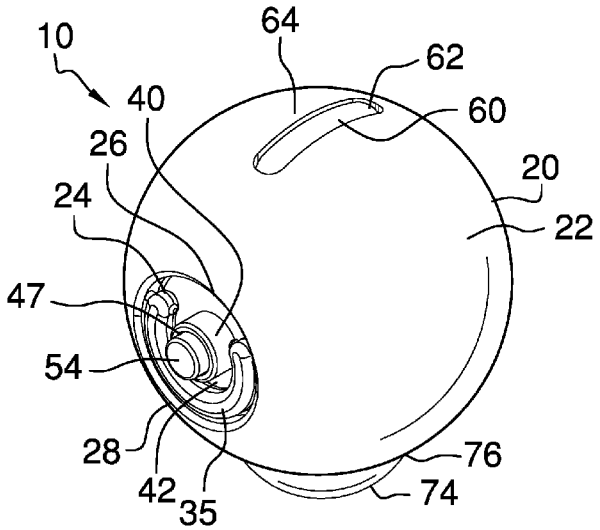
FIG. 1 is an isometric view showing a bar in a retracted condition.
Figure 2:
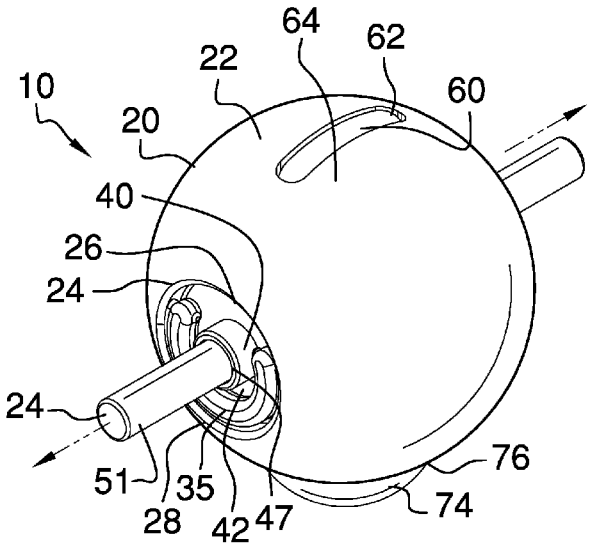
FIG. 2 is an isometric view showing a pair of the bars in an extended condition.
Figure 3:
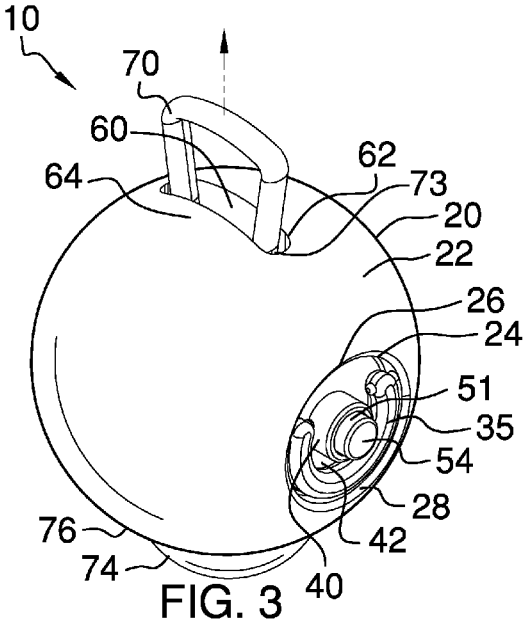
FIG. 3 is an isometric view showing a grip member in a partially extended condition.
Figure 4:
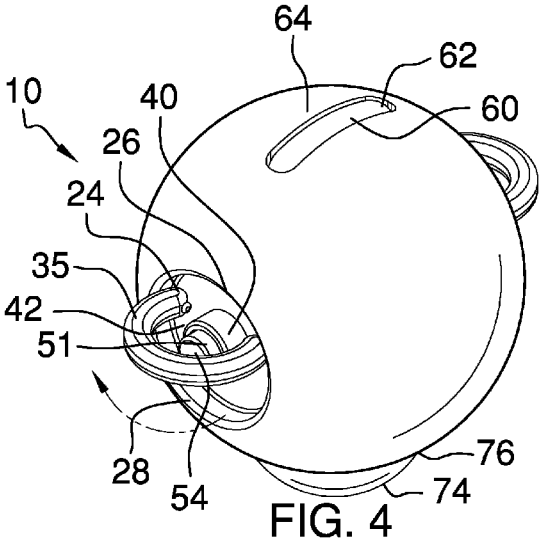
FIG. 4 is an isometric view showing a pair of handles in a raised condition.
Figure 5:
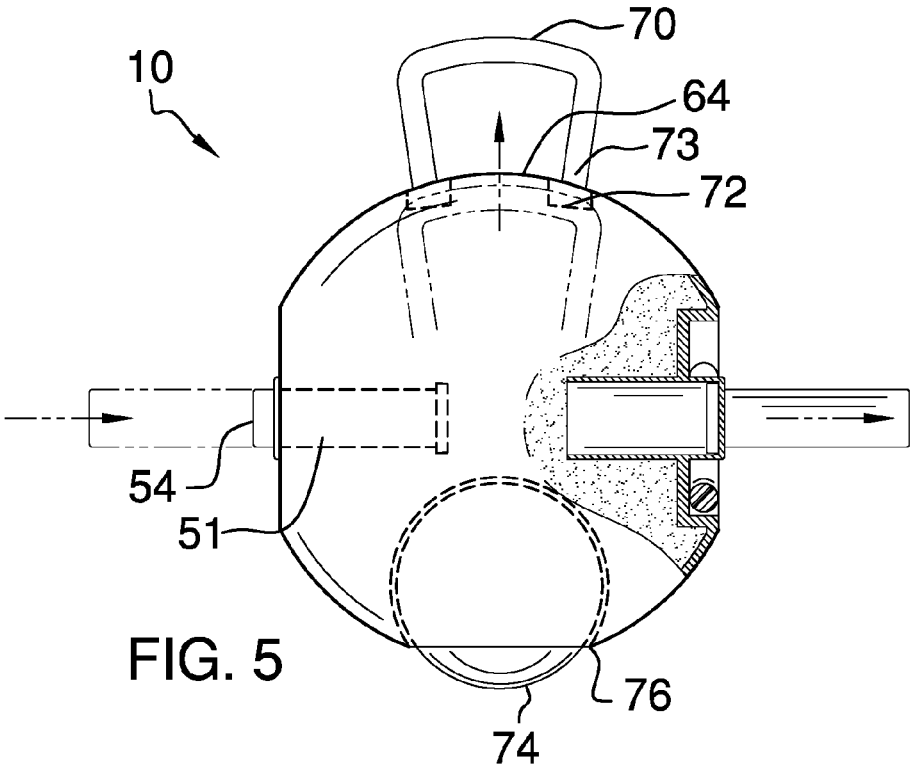
FIG. 5 is a side view with a partial cutaway view showing a pair of indents in the outer wall and showing the rotatability and extendibility of the pair of bars.
Figure 6:
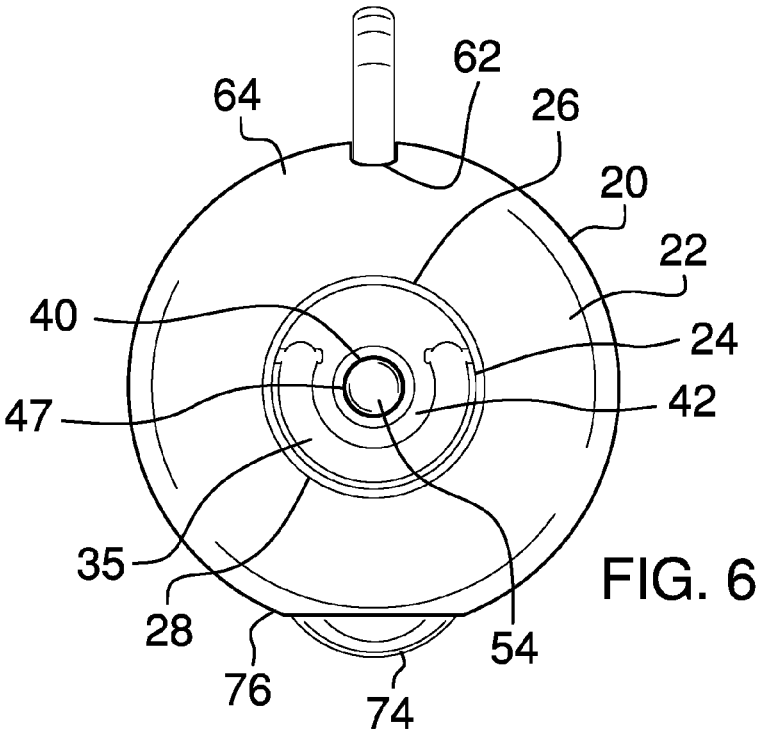
FIG. 6 is a side elevation view showing one of the handles in a retracted condition within one of the indents.

With reference now to the drawings, and in particular FIGS. 1 through 9 thereof, an example of the instant multiple exercise medicine ball employing the principles and concepts of the present multiple exercise medicine ball and generally designated by the reference number 10 will be described.

Referring to FIGS. 1 through 8 the present multiple exercise medicine ball 10 is illustrated. The multiple exercise medicine ball 10 includes a medicine ball body 20 having an outer wall 22 and a weighted core 23. A pair of hemispherical indents 24 is disposed in the outer wall 22. The indents 24 are diametrically opposed to each other. Each indent 24 has a top end 26, a bottom end 28, and an apex 30 disposed approximately midway between the outer wall 22 and a longitudinal midline axis of the medicine ball body 20. The core 23 is formed of a gel material.

A pair of u-shaped pivotable handles 35 is provided. Each handle 35 having a lowered condition and a raised condition, wherein each of the handles 35 is disposed with a respective one of the indents 24 proximal the bottom end 28 when the handle 35 is in the lowered condition, wherein each of the handles 35 is extended away from the respective one of the indents 24 when the handle 35 is in the raised condition. When the pair of handles 35 is in the raised condition, the medicine ball body 20 can be lifted and lowered for use as a barbell or a curl bar. When a single one of the handles 35 is raised, the medicine ball body 20 can be lifted and lowered for use as a dumbbell.

An annular support member 40 is centrally disposed within each of the indents 24 in a position within a gap 42 of the respective handle 35. A pair of channels 45 is disposed in the medicine ball body 20 core 23. Each of the pair of channels 45 has an opening 47 centrally disposed with a respective one of the annular support members 40 and a terminal end 49 disposed between the apex 30 of the respective indent 24 and the longitudinal midline axis of the medicine ball body 20.

Figure 7:
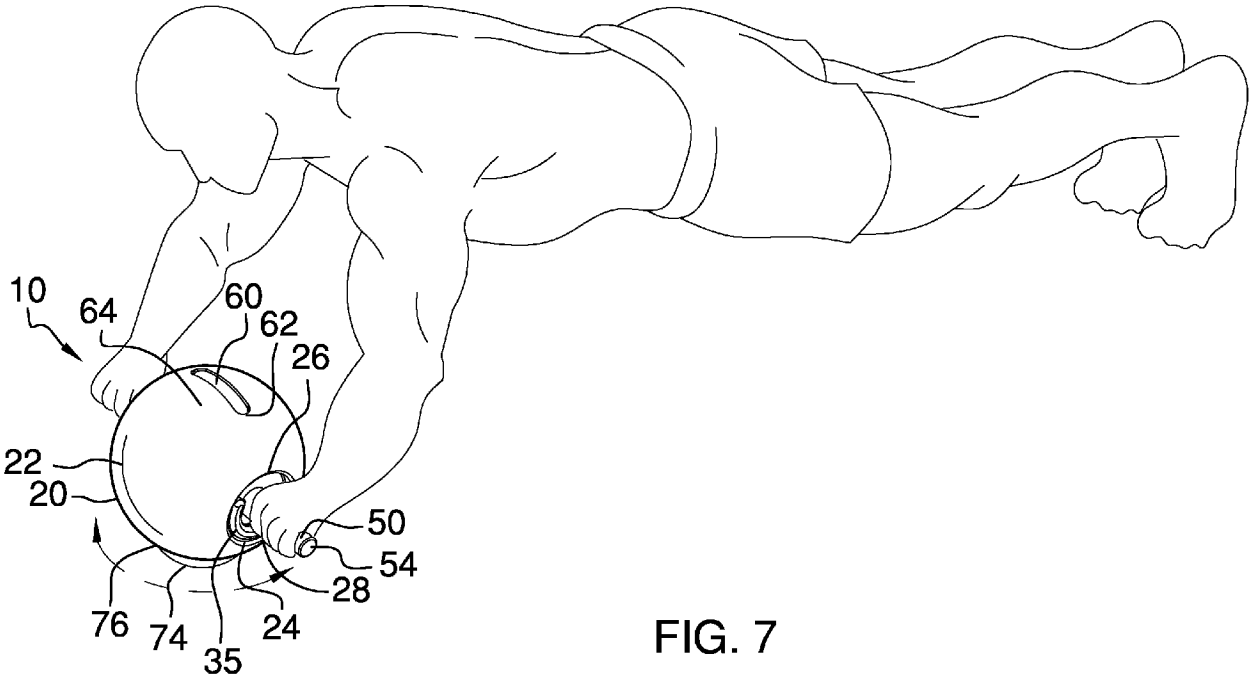
FIG. 7 is an in-use view showing use as an abdominal wheel exerciser with the pair of bars in an extended condition.

A cylindrical bar 51 is rotatably disposed within each of the channels 56 and extendible from the respective one of the channels 56. Each bar 51 has an internal end 53, an external end 54, and a cylindrical stop 56 on the internal end 53. The stop 56 has a diameter greater than a diameter of the bar 51 to secure the internal end 53 with the channel 56 when the bar 51 extended from the respective channel 56. When the cylindrical bars 51 are extended from the channels 56, the medicine ball body 20 is rotatable relative the bars 51 to roll back and forth across an exercise surface for use as an abdominal wheel exerciser. Thus, the user can position himself in a position for performing pushup exercise, but rather than placing the user's hands on the exercise surface, the user extends and grips the bars 51, as shown in FIG. 7, and rolls the medicine ball body 20 toward and away from himself.

Figure 8:
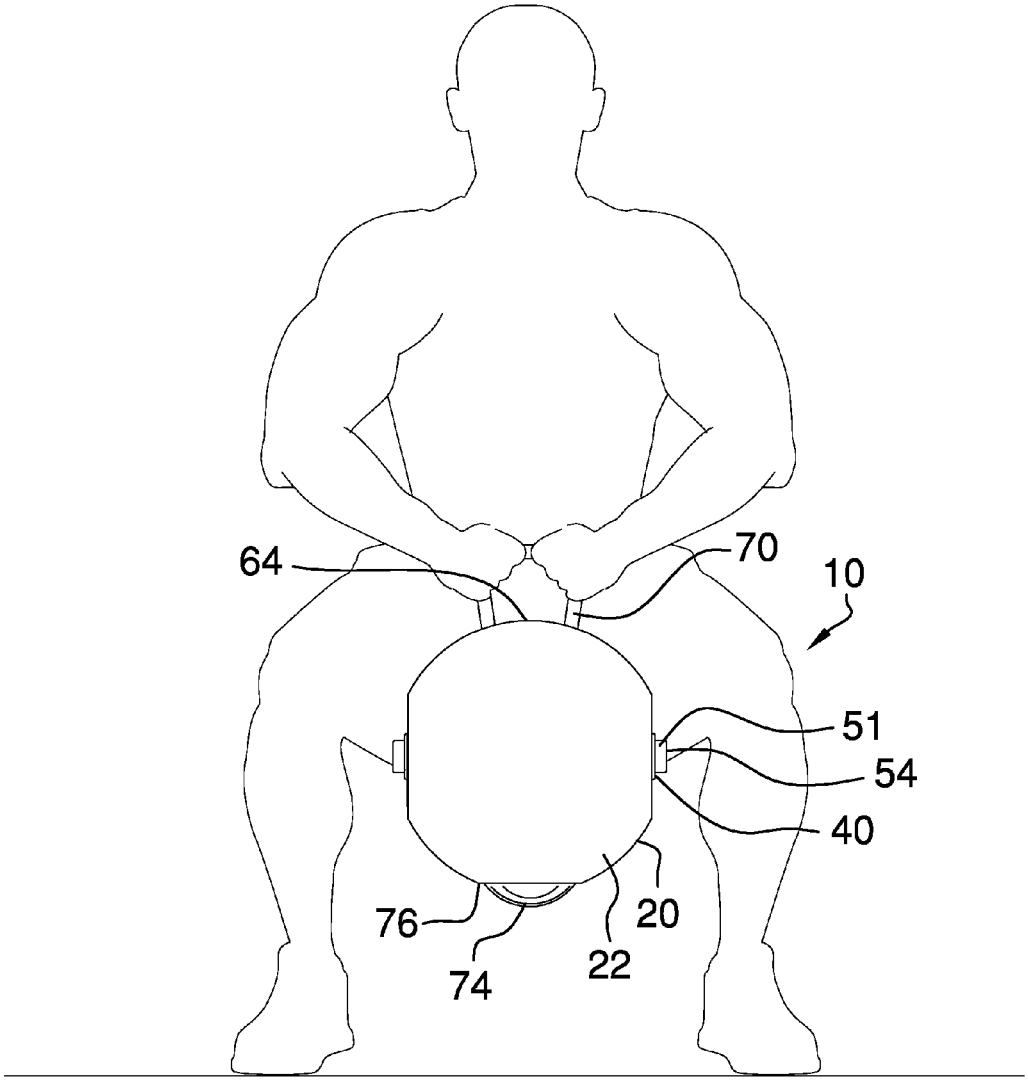
FIG. 8 is an in-use view showing the grip member in an extended condition for kettlebell fitness training.
Figure 9:
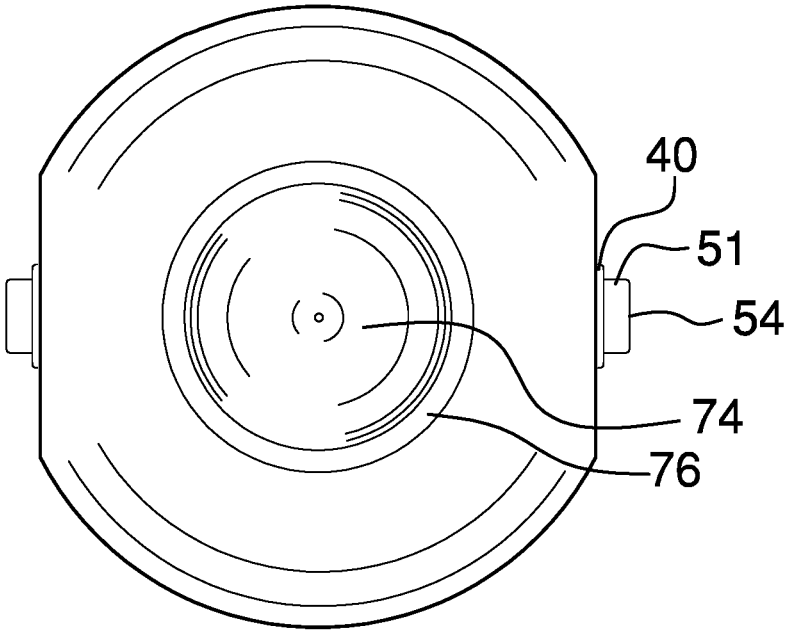
FIG. 9 is a bottom plan view.

An inverted substantially u-shaped conduit 60 is disposed within the medicine ball body 20. The conduit 60 has an obround aperture 62 centrally disposed atop the outer wall 22 in a position parallel to the channels 56. The aperture 62 is disposed more proximal a top side 64 of the medicine ball body 20 than the indents 24. A convex grip member 70, which has a retracted condition and an alternate extended condition, is slidingly disposed within the conduit 60 when the grip member 70 is in the retracted condition and is extended outside the outer wall 22 beyond the top side 64 of the medicine ball body 20 in the alternate extended condition. The grip member 70 is provided to allow the medicine ball body 20 to be held, lifted, and lowered for kettlebell fitness training, as shown in FIG. 8, thus allowing the user to perform a number of exercises, including a swing exercise in which the user projects the medicine ball body 20 to shoulder-height only and then swings the medicine ball body 20 between the user's legs while squatting and also a goblet squat exercise in which the user squats with the elbows proximal to the knees, holds the medicine ball body 20 at chest height and then moves to an upright standing position without moving the position of the medicine ball body 20. A stop member 72 disposed on each of an external end 73 of the grip member 70 prevents the grip member 70 from sliding out of the medicine ball body 20. A 360 degree rotatable motion ball 74 is disposed within a bottom side 76 of the medicine ball body 20. A portion of the motion ball 74 protrudes beyond the outer wall 22. The motion ball 74 allows the medicine ball body 20 to move in any direction rather than just frontwardly and rearwardly. In addition, to the exercises described hereinabove, the user can also use the present device 10 to engage in a wide range of strength-training exercises to add resistance to movements during various exercises such as sit-ups, crunches, cardio exercises, and jumps.

What is claimed is:

1. A multiple exercise medicine ball comprising:

a medicine ball body having an outer wall and a core;

a pair of hemispherical indents disposed in the outer wall, the indents being diametrically opposed to each other, each indent having a top end, a bottom end, and an apex disposed approximately midway between the outer wall and a longitudinal midline axis of the medicine ball body;

a pair of u-shaped pivotable handles, each handle having a lowered condition and a raised condition, wherein each of the handles is disposed with a respective one of the indents proximal the bottom end when the handle is in the lowered condition, wherein each of the handles is extended away from the respective one of the indents when the handle is in the raised condition;

an annular support member centrally disposed within each of the indents in a position within a gap of the respective handle;

a pair of channels disposed in the medicine ball body core, each of the pair of channels having an opening centrally disposed with a respective one of the annular support members and a terminal end disposed between the apex of the respective indent and the longitudinal midline axis of the medicine ball body;

a cylindrical bar rotatably disposed within each of the channels and extendible from the respective one of the channels, each bar having an internal end and an external end, each bar having a cylindrical stop on the internal end, the stop having a diameter greater than a diameter of the bar;

an inverted substantially u-shaped conduit disposed within the medicine ball body, the conduit having an obround aperture centrally disposed atop the outer wall in a position parallel to the channels, the aperture more proximal a top side of the medicine ball body than the indents;

a convex grip member having a retracted condition and an alternate extended condition, the grip member being slidingly disposed within the conduit when the grip member is in the retracted condition, the grip member being extended outside the outer wall beyond the top side of the medicine ball body and a stop arm of the grip member remaining within the medicine ball body in the alternate extended condition;

a stop member disposed on each of an external end of the grip member; wherein the stop member is configured to prevent the grip member from sliding out of the medicine ball body; and a 360 degree rotatable motion ball disposed within a bottom side of the medicine ball body, wherein a portion of the motion ball protrudes beyond the outer wall.

2. The multiple exercise medicine ball of claim 1 wherein the core is formed of a gel material.

* * * * *